US005443267A

United States Patent [19]

Thorson

[11] Patent Number: 5,443,267

[45] Date of Patent: Aug. 22, 1995

[54] GOLF TRAINING DEVICE

[76] Inventor: Ronald W. Thorson, 497 Georgia Hwy., Franklin, N.C. 28734

[21] Appl. No.: 331,744

[22] Filed: Oct. 31, 1994

[51] Int. Cl.[6] ..... A63B 69/36

[52] U.S. Cl. ..... 273/188 A; 128/882; 273/187 B

[58] Field of Search ..... 273/187.2, 188 R, 188 A, 273/187 B; 128/882

[56] References Cited

U.S. PATENT DOCUMENTS

| | | | |
|---|---|---|---|
| 2,847,769 | 8/1958 | Schlesinger | 273/188 A |
| 2,891,796 | 6/1959 | Cottrell | 273/189 R |
| 3,606,341 | 9/1971 | Honbarger | 273/188 R |
| 4,088,326 | 5/1978 | Bifulco | 273/188 R |
| 4,103,897 | 8/1978 | Ostyn | 273/188 A |
| 4,106,771 | 8/1978 | Fern | 273/188 A X |
| 4,817,953 | 4/1989 | Ponchak | 273/188 R |

*Primary Examiner*—George J. Marlo
*Attorney, Agent, or Firm*—Nies, Kurz, Bergert & Tamburro

[57] ABSTRACT

A golf training device embodies a leg brace which restricts improper leg movement during a golf swing. The device engages the foot and lower leg and may be worn inside the shoe of the golfer. When strapped on the rear leg, the device prevents reverse weight shift while allowing fore and aft pivoting of the ankle. Alternatively, the device may be worn on the forward leg so as to prevent excessive forward weight shift.

9 Claims, 3 Drawing Sheets

FIG. 3
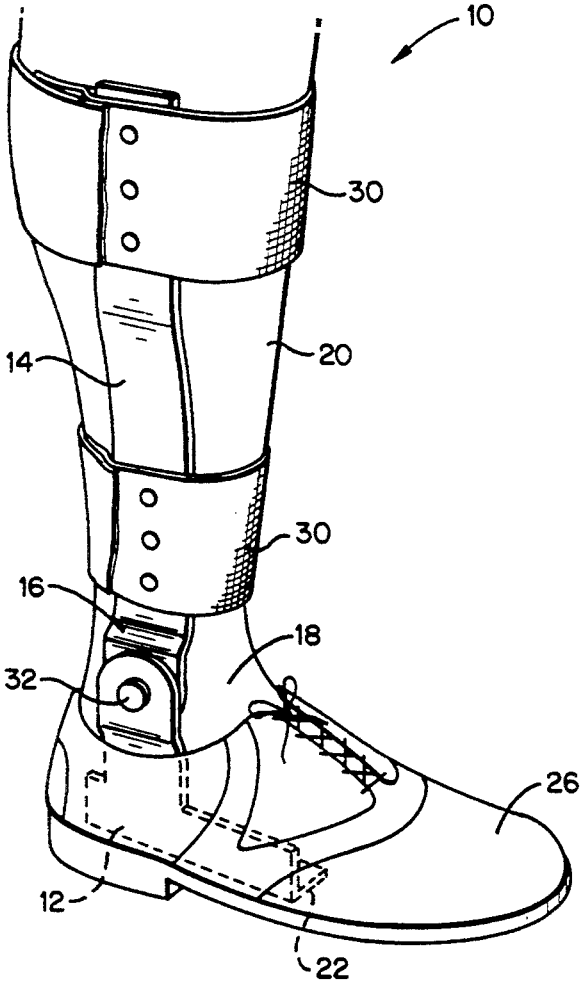
FIG. 7
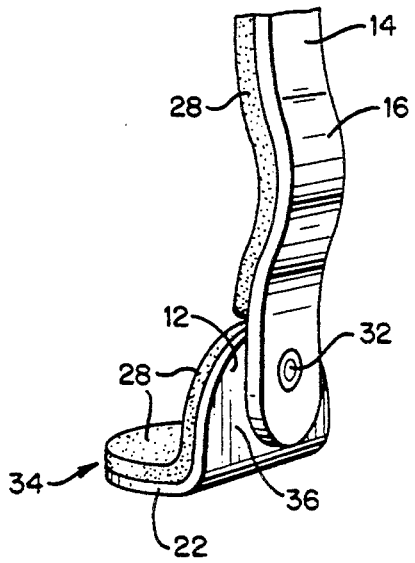
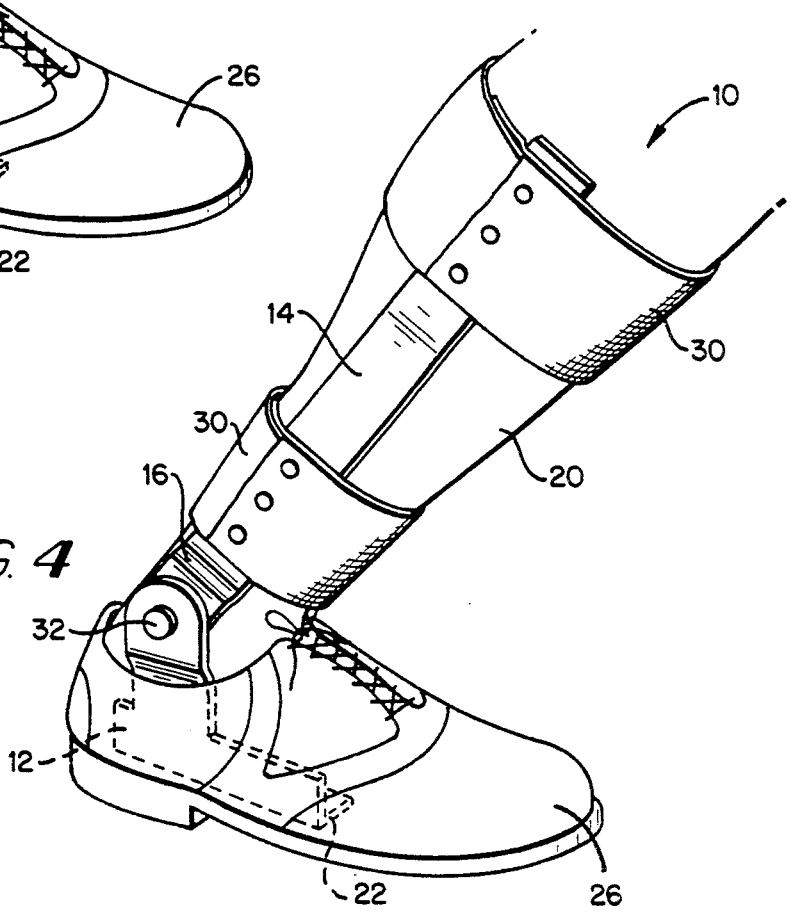
FIG. 4

GOLF TRAINING DEVICE

BACKGROUND AND SUMMARY OF THE INVENTION

The present invention relates to a golf training device, and more particularly to a brace attachable to the leg of a golfer which restricts improper leg movement during the golf swing.

It is well known in the golfing world that improper swaying during the golf swing is one of many poor habits which can result in a poor golf shot, such as a slice, duck hook, topped shot, or the like. Especially when hitting from sand traps or on short shots around the green, it is very important to keep the legs quiet, i.e., avoid swaying. By lessening or eliminating the sway, the golfer can produce a more consistent, successful golf shot. One of the most successful ways of eliminating swaying is through muscle memory, or, repetitious practice of the feel of the non-swaying swing.

A variety of devices have been developed to try to train the golfer not to sway during the golf swing. Such devices are described, for example, in the following U.S. Pat. Nos.: 2,891,796 to Gotttell; 3,606,341 to Honbarger; 4,088,326 to Bifulco; 4,103,897 to Ostyn; 4,106,771 to Fern; and 4,817,953 to Ponchak.

Notwithstanding these devices, there remains a need for a device which can be easily worn during a round of golf and which provides sufficient rigidity to prevent improper swaying.

It is thus one object of the present invention to provide a golf training device which restricts improper leg movement and thereby prevents undesirable swaying during the golf swing.

It is another object of the present invention to provide a golf training device which can be easily worn during a round of golf.

It is a further object of the present invention to provide a golf training device which can fit inside the shoe of the user.

It is another object of the present invention to provide a golf training device which, when worn, prevents side to side movement of the user's leg while still allowing the user to walk.

BRIEF DESCRIPTION OF THE DRAWINGS

FIG. 3 is a perspective view of another embodiment of the golf training device of the present invention shown installed on the leg of the user.

FIG. 4 is a perspective view of the golf training device of FIG. 3 shown in the forward position on the leg of the user.

FIG. 7 is a perspective view of a third embodiment of the golf training device of the present invention.

DETAILED DESCRIPTION OF THE PREFERRED EMBODIMENTS

Figure 1:
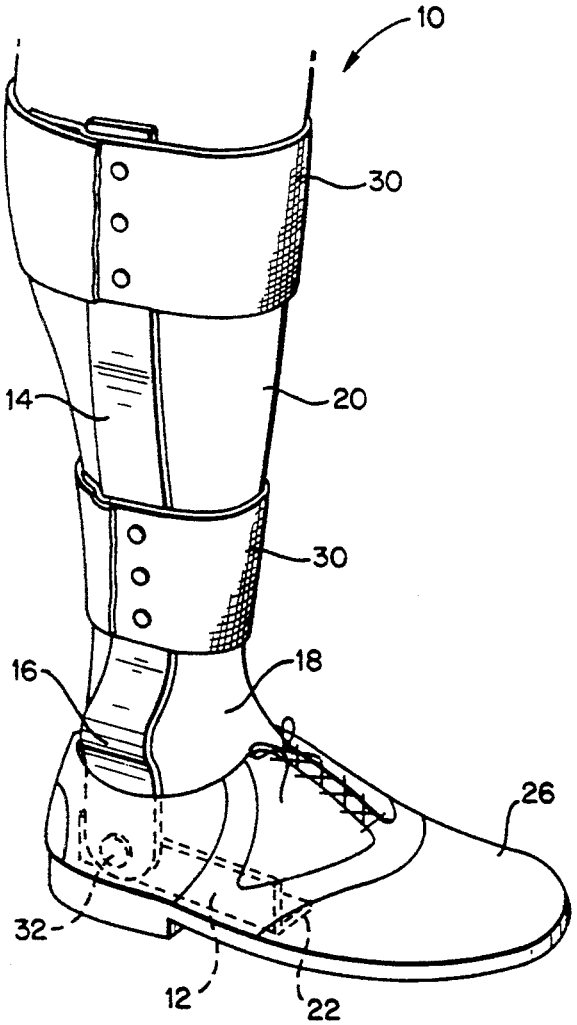
FIG. 1 is a perspective view of the golf training device of the present invention shown installed on the leg of a user.

With reference to FIGS. 1 through 7, by the present invention there is provided a golf training device 10 for use primarily on the rear or load-bearing leg 20 of a golfer. The device includes a lower base member 12 connected to an upper brace member 14. Upper brace member 14 extends from the lower base member 12 to just below the knee of the user and is formed of a one-piece metallic plate having a curved portion 16 designed to conform to the shape of the ankle 18 and leg 20 of a user wearing the device 10. Lower base member 12 can be a one-piece metallic plate formed in an L-shape in cross section such that the bottom portion 22 of the L-shape is capable of being placed under the foot 24 of the user. The entire lower base member 12 is capable of being placed inside the shoe 26 of the user.

Lower base member 12 and upper brace member 14 can be provided on their interior surfaces 15, 17 with a layer of padding 28 such as pile material, compressed foam, or the like, resulting in greater comfort for the user. Additionally, upper brace member 14 is provided with strap members 30 at spaced intervals along the length of the upper brace member 14 for secure attachment of the golf training device 10 to the leg 20 of the user. Strap members 30 may be made of neoprene rubber or other suitable material and are capable of extending completely around the leg 20 of a user and being held securely thereto through the use of snaps, Velcro materials or the like.

Figure 2:
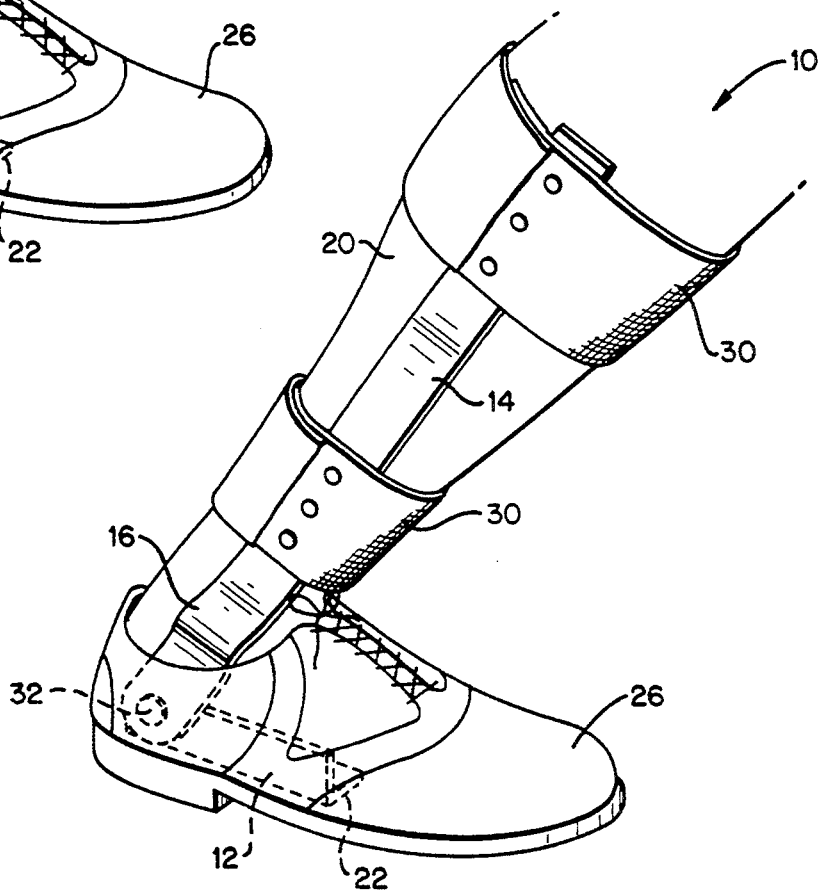
FIG. 2 is a perspective view of the golf training device of FIG. 1 shown in the forward position on the leg of a user.
Figure 5:
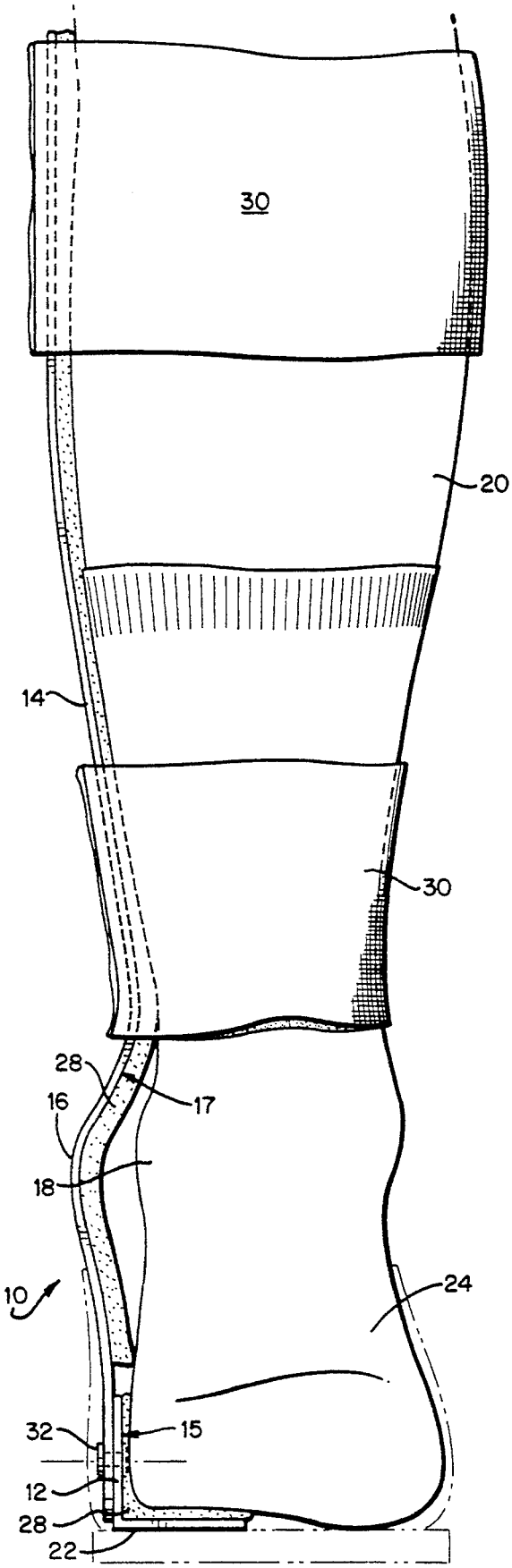
FIG. 5 is a front view of the user's ankle and foot corresponding to FIG. 1.
Figure 6:
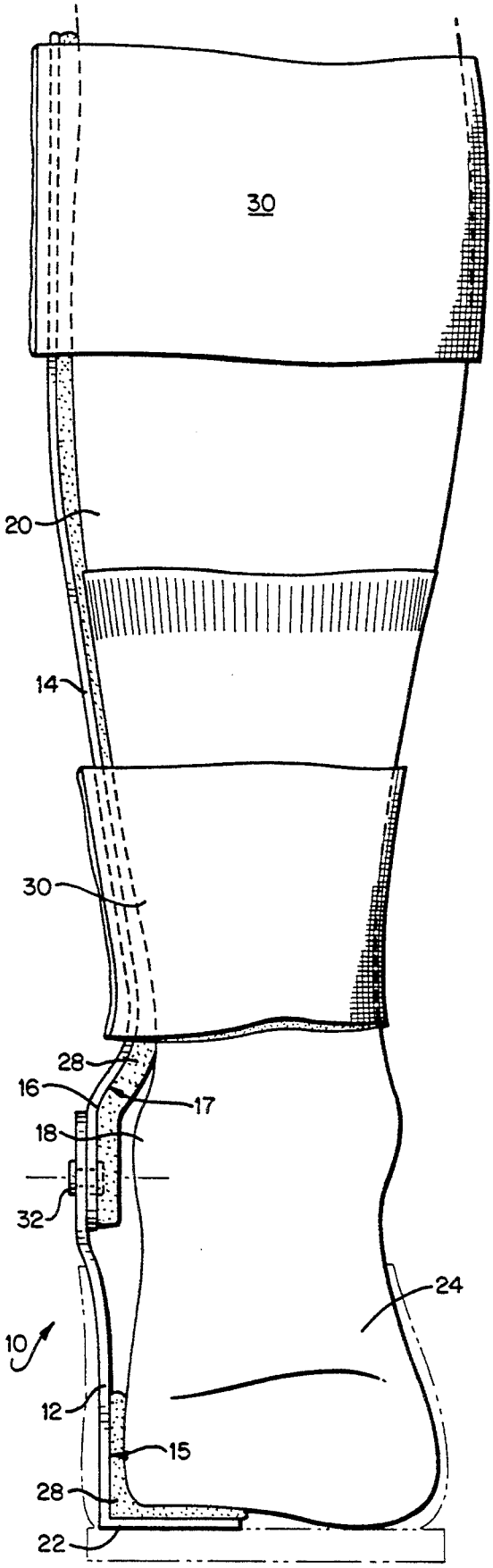
FIG. 6 is a front view of the user's ankle and foot corresponding to FIG. 3.

Lower base member 12 and upper brace member 14 may be pivotally connected by a pivot or swivel pin 32 which allows rotation of the lower base member 12 along the same plane as the upper brace member 14. This capability for rotation of lower base member 12 allows the user to move his or her leg 20 forward, as shown in FIGS. 2 and 4, and thereby walk while wearing the device 10. In one embodiment of the invention, as shown in FIGS. 1, 2, and 5, the swivel pin 32 is provided below ankle level. In another embodiment of the invention, as shown in FIGS. 3, 4, and 6, the swivel pin 32 is provided at ankle level. At the point of connection, the upper brace member 14 may be either on the outside or the inside of lower base member 12. The device 10 will not allow the leg 20 to roll or move sideways when the foot is resting on the ground.

In a preferred embodiment of the invention as shown in FIG. 7, lower base member 12 has a rounded edge 34 and is symmetrically located about the vertical axis of upper brace member 14. Additionally, upper brace member 14 is connected to the outer surface 36 of lower base member 12. This embodiment allows the user to easily adapt the device 10 to either the left or right leg.

In operation, a user desiring to eliminate the swaying motion in his or her golf swing places the rear or load bearing foot 24, i.e., the right foot of a right-handed golfer, on top of the bottom portion 22 of lower base member 12 and straps upper brace member 14 to the leg using strap members 30, as shown in FIGS. 5 and 6. The bottom portion 22 of lower base member 12 fits under the outside of the foot 24 and inside the shoe 26 to force the weight placed on the foot 24 to the inside part of the foot 24. This helps the user maintain proper balance during the golf swing while still allowing the user to take a full golf swing. After consistent golf swing practice wearing the training device of the present invention, the user should be able to achieve the same swing without the brace on, having effectively trained his or her muscle memory not to sway. The device 10 can also be worn on the outside of the golfer's front leg to keep the golfer from overshifting his or her weight past the golf ball during the golf swing.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A golf training device for preventing undesirable swaying during a golf swing, comprising:

a lower base member;

an upper brace member;

attachment means for attaching said lower base member to said upper brace member such that said lower base member can rotate about an axis perpendicular to the plane of said upper brace member;

means for releasably securing said upper brace member to a leg of a golfer, said lower base member including an upper portion and a bottom portion which forms an L-shape in cross section, said bottom portion including upper and lower planar surfaces for positioning underneath a foot of said golfer, and said bottom portion of said lower base member being of a size so as to fit inside a shoe of said golfer.

2. The golf training device of claim 1 wherein the bottom portion of said lower base member has a rounded edge along its periphery.

3. The golf training device of claim 1 wherein said lower base member is symmetrically aligned with respect to the vertical axis of said upper brace member.

4. The golf training device of claim 1 wherein said upper brace member is curved so as to conform to a leg and ankle of said golfer.

5. The golf training device of claim 1 wherein said upper brace member is of a size capable of extending from a point below the knee of said leg of said golfer to the lower base member.

6. The golf training device of claim 1 wherein said lower base member is provided with padding on its interior surfaces.

7. The golf training device of claim 1 wherein said upper brace member is provided with padding on its interior surfaces.

8. The golf training device of claim 1 wherein said attachment means includes a swivel pin which allows rotation of said lower base member in a forward to backward manner with respect to said upper brace member.

9. The golf training device of claim 1 wherein said releasable securing means includes at least one strap member.

* * * * *